US006053197A

United States Patent [19]

Gorges

[11] Patent Number: 6,053,197

[45] Date of Patent: Apr. 25, 2000

[54] HORIZONTAL-FLOW OIL-SEALANT-PRESERVING DRAIN ODOR TRAP

[76] Inventor: Ditmar L. Gorges, 11660 Mayfield Ave., No. 401, Brentwood, Calif. 90049

[21] Appl. No.: 09/051,976

[22] Filed: Sep. 14, 1998

Related U.S. Application Data

[63] Continuation-in-part of application No. 08/548,281, filed as application No. PCT/US95/16064, Dec. 11, 1995, abandoned.

[51] Int. Cl.[7] ..... E03C 1/29; E03C 1/28

[52] U.S. Cl. ..... 137/247.39; 137/362; 4/144.1; 4/679

[58] Field of Search ..... 137/246, 247.11, 137/247.33, 247.35, 247.39, 362; 4/144.1, 310, 311, 679

[56] References Cited

U.S. PATENT DOCUMENTS

| | | | |
|---|---|---|---|
| 303,430 | 8/1884 | Griffin | 137/247.33 X |
| 303,822 | 8/1884 | D'Heureuse | 4/679 |
| 668,776 | 2/1901 | Riley | 137/247.11 X |
| 748,936 | 1/1904 | Edelen | 137/247.33 X |
| 818,164 | 4/1906 | Hannagan | 137/247.33 |
| 1,050,290 | 1/1913 | Posson | 4/223 |
| 1,596,997 | 8/1926 | Rawlings | 137/247.33 |
| 2,603,304 | 7/1952 | Carrier | 137/247.11 |
| 3,829,909 | 8/1974 | Rod et al. | 4/DIG. 11 |
| 4,026,317 | 5/1977 | Ekstrom | 137/247.39 X |
| 4,028,747 | 6/1977 | Newton | 4/317 |
| 4,043,354 | 8/1977 | Brown | 137/247.33 |
| 4,045,346 | 8/1977 | Swaskey | 137/247.39 X |
| 4,244,061 | 1/1981 | Webster et al. | 4/144.1 |
| 4,263,934 | 4/1981 | Redden et al. | 137/247.39 X |
| 4,275,760 | 6/1981 | Kessel | 137/247.35 |
| 4,411,286 | 10/1983 | Ball | 137/253 |
| 4,432,384 | 2/1984 | Guiboro | 137/247.39 X |
| 4,773,441 | 9/1988 | Biba | 137/247.33 X |
| 4,922,948 | 5/1990 | Dijk | 137/247.33 |
| 5,159,724 | 11/1992 | Vosper | 137/247.35 X |
| 5,203,369 | 4/1993 | Hwang | 137/247.39 |
| 5,711,039 | 1/1998 | Reichardt et al. | 4/679 X |

FOREIGN PATENT DOCUMENTS

| | | | |
|---|---|---|---|
| 663749 | 8/1929 | France | 137/247.33 |
| 1413819 | 8/1965 | France . | |
| 72361 | 1/1894 | Germany . | |
| 121356 | 6/1901 | Germany . | |
| 318264 | 6/1918 | Germany . | |
| 2816597 | 5/1980 | Germany . | |
| 241369 | 7/1946 | Switzerland . | |
| 01002 | 3/1868 | United Kingdom . | |
| 2078813 | 1/1982 | United Kingdom . | |
| 9425693 | 11/1994 | WIPO . | |

*Primary Examiner*—John Rivell
*Attorney, Agent, or Firm*—Rothwell, Figg, Ernst & Kurz

[57] ABSTRACT

Improvements in retention of the oily liquid sealant in a oil-sealed odor trap, for drain applications such as a waterless urinal or anti-evaporation floor drain, are accomplished by making the liquid flow path substantially horizontal as a departure from conventional practice of substantially vertical flow. The trap is structured to realize the substantially horizontal liquid flow path and to locate the flow path immediately beneath the sealant layer or beneath a baffle portion that is sloped such that stray sealant droplets migrating upwardly to the upper surface of the flow path due to their buoyancy will be recaptured and returned to the main sealant layer. To accomplish substantially horizontal flow, the entry compartment can be made to have entry and exit openings substantially offset from each other. The baffle between the entry compartment and the discharge compartment, which has traditionally been made entirely vertical, is made to have a non-vertical portion that is preferably sloped for sealant recovery. A sealant sheltering region can be provided in the vicinity of the entry region to prevent catastrophic loss of sealant in the event of high pressure water flushing.

35 Claims, 5 Drawing Sheets

FIG. 13
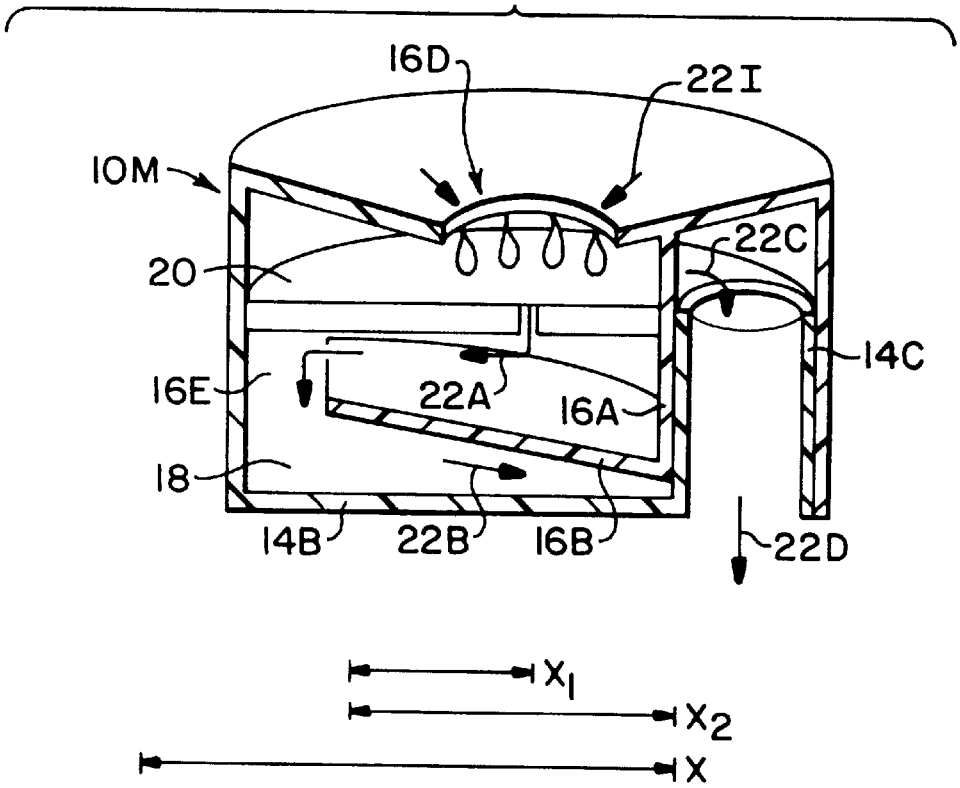
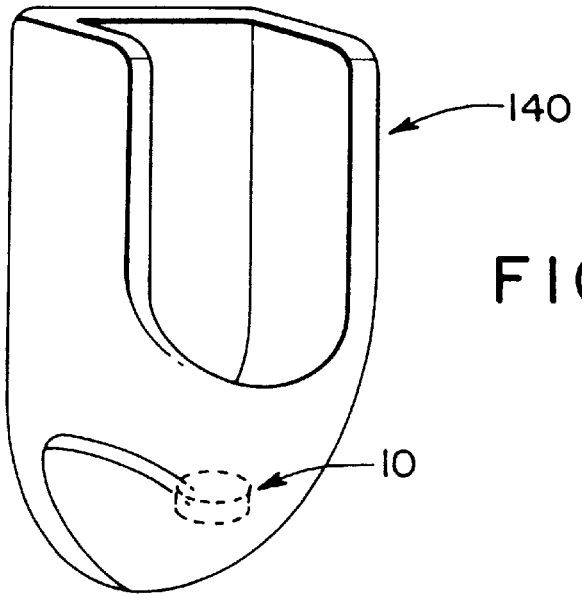
FIG. 14

HORIZONTAL-FLOW OIL-SEALANT-PRESERVING DRAIN ODOR TRAP

The present application is a Continuation-in-Part of both U.S. patent application Ser. No. 08/548,281, filed Oct. 25, 1995, now abandoned, and PCT Application No. PCT/US 95/16064, filed Dec. 11, 1995, both entitled Horizontal-Flow Oil-Sealant-Preserving Drain Odor Trap.

TECHNICAL FIELD

The present invention relates to sealed odor traps for waterless urinals, anti-evaporation floor drain traps, and the like, and it is more particularly directed to improvements in the internal structure of oil-sealed odor traps for prolonging sealant retention and for protection against high pressure water flushing.

BACKGROUND OF THE INVENTION

With increasing emphasis on water conservation, there is renewed interest in toilets and urinals designed to minimize the amount of water consumed in flushing to mitigate excessive demands on water supplies as well as on waste-water disposal systems, both of which have tended to become overloaded with increasing populations.

Sanitation codes require urinals to provide an odor seal to contain gasses and odors which develop in the drain system: this function is conventionally performed by the well known P-trap or S-trap in which the seal is formed by a residual portion of the flushing water. This seal effectively locks in sewer odors from the drainpipe beyond the trap, however the upward-facing liquid surface communicates freely with the user environment, so that the trap must be kept free of residual urine by copious flushing to prevent unacceptable odor levels from the liquid in the trap; therefore a large amount of water is consumed in flushing these conventional urinals. Especially in the U.S. over many years when water was cheap and plentiful, conventional flushing type urinals and water-wasteful toilets held an unchallenged monopoly. However more recently, threatened and real water shortages have aroused new environmental concerns and heightened conservation awareness as evidenced by the introduction of low flush toilets.

As the cost of water increases and budgets tighten, the prospect of a viable waterless urinal system becomes extremely attractive to a wide range of public agencies, cities, states, penal institutions, defence establishments, recreational and parks departments and the like. Waterless urinals utilizing oil-sealed odor traps are becoming viable. However, the present inventor has discovered that a key factor in their potential is the attainment of low maintenance, and that this is largely dependent on the longevity of the liquid sealant, which in turn is related to the internal structure of the odor trap. Thus, the present inventor has recognized that improvements are desirable both in the rate of depletion under normal service conditions and in protection against catastrophic sealant loss due to high pressure water flushing, which though not required, can occur inadvertently.

It is a primary object of the present invention to provide an improved oil sealed odor trap for a flushless urinal or an anti-evaporation floor drain that not only meets the usual objectives of eliminating the need for a P-trap in the drain line while complying with U.S. sanitation standards, being economical and easy to manufacture and install, and performing reliably and efficiently with low maintenance requirements, but more particularly with regard to depletion of oily liquid sealant, it is a primary object to structure the trap in a manner to largely prevent escape of sealant by causing stray droplets of sealant drifting buoyantly in the flow path to return to the main sealant body.

It is a further object to configure the odor trap such that it can be easily installed and removed from a permanent drain terminal plumbing fixture.

It is still further object that the odor trap should be constructed and arranged to prevent loss of sealant in the event of high pressure flushing with water.

STATEMENT OF THE PRIOR ART

The use of oil in toilets to form an odor trap has been disclosed in German Patent No. 121356 (Beck, et al.) and in U.S. Pat. No. 1,050,290 (Posson) and U.S. Pat. No. 4,028,747 (Newton).

Other examples of oil-sealed traps are found in German Patent No. 2816597.1, and Swiss Patent No. 606,646 (Ernst), practiced under the trademark SYSTEM-ERNST.

German Patent No. 2816597.1 appears to show an oil-sealed trap located in the sewer drain of a urinal system that is capable of holding an oil sealant. The '597 reference appears to show a large vertical baffle separating the trap into entry and discharge sections and inlet openings in the entry section adjacent the large vertical baffle. In addition, the '597 reference appears to show an overflow standpipe extending down below the floor portion of the trap.

A unitized cylindrical cartridge odor seal for a waterless urinal was disclosed by the present inventor as a joint inventor in U.S. patent application Ser. No. 08/052,668 filed Apr. 27, 1993 and in a continuation-in-part thereof Ser. No. 08/512,453 filed Aug. 8, 1995, in the category of an oil-sealed coaxial edge-entry trap having a cap part with an attached downward-extending tubular vertical partition.

A key parameter of oil-sealed odor traps for waterless urinals is the amount of sealant depletion that takes place under normal service conditions over periods of time and frequency of usage. Related to this is the possible partial or complete loss of sealant due to the abnormal condition of unnecessary but unavoidable high pressure flushing with water. While some modern oil-sealed odor traps are considerably improved over early versions, there remains an unfulfilled need for further improvements in the above-described aspects of sealant preservation: such improvements are provided by the present invention.

STATEMENT OF THE INVENTION

The above and other objects have been met in the present invention of a unitized plastic oil-sealed odor trap that departs from conventional practice of predominantly vertical liquid flow through the trap, instead the trap is constructed and arranged in a special manner such that a substantial portion of the total flow path is made to be generally horizontal and to be located in a region where stray droplets of sealant, due to buoyancy, will migrate upwardly back to the main sealant body, either directly or as guided by a sloping baffle configuration. Thus, escaping of sealant down the drain is largely prevented.

The odor trap is configured such that it can be economically made from two molded plastic parts, i.e., a main compartment part and a cap/baffle part, that can be molded from plastic and joined by thermal bonding into a unit configured as a replaceable cylindrical cartridge that can be charged with sealant and sealed with a sticker for shipment so that upon installation it is necessary only to install the cartridge and remove the sticker.

In service, required maintenance, i.e. sealant checking and replenishment, if and when needed, can be easily performed with the unit in place.

The cartridge is shaped to be easily pushed into place by hand and held frictionally in a mating recess provided by a casing that can be installed as part of the host plumbing, either in a urinal or in a floor drain. For drain cleaning or replacement purposes, the odor trap can be removed with a special simple hand tool.

The shape of the entry compartment provides a sheltered region to which sealant tends to be temporarily displaced in the event of high pressure water flushing, thus avoiding catastrophic sealant loss.

BRIEF DESCRIPTION OF THE DRAWINGS

The above and further objects, features and advantages of the present invention will be more fully understood from the following description taken with the accompanying drawings in which:

FIG. 13 shows a cross-sectional view of another preferred embodiment of the present invention;

FIG. 14 shows an example of a wall mounted urinal in which an odor trap can be incorporated;

FIG. 15 is a bottom view of a top member thereof; FIG. 16 is a perspective side view of a middle member thereof; FIG. 17 is a perspective side view of a bottom member thereof (with upper and middle members represented in part in dotted lines); and FIG. 18 is a perspective side view of a plug-handle member capable of being included in this embodiment.

DETAILED DESCRIPTION OF THE INVENTION

Figure 1:
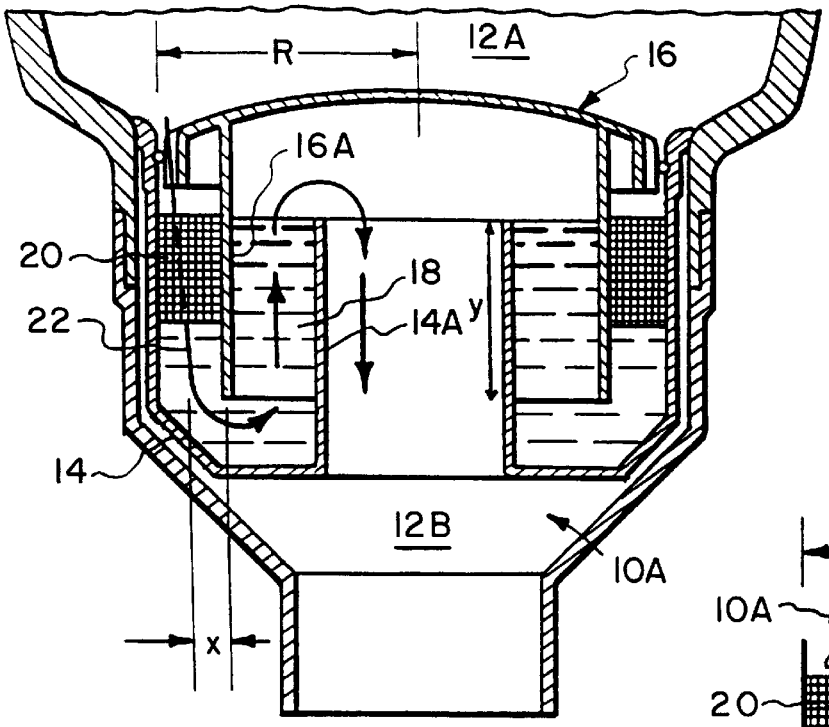
FIG. 1 (PRIOR ART)
FIG. 1 is a cross-sectional view of an oil-sealed coaxial odor trap of known art.

FIG. 1 is a mid cross-sectional view of an odor trap 10A of the edge-entry trap configuration of known art as described above, configured as a cylindrical cartridge.

Odor trap 10A has a main liquid container 14 extending from an outer wall to an inner wall that forms a drain stand pipe 14A defining at its upper edge the overflow level of liquid in the container 14. An overhead cap portion 16 is formed to provide a vertical baffle 16A extending down into container 14 dividing it into an inner discharge compartment and a surrounding entry compartment. A body of residual urine 18 extends up to the overflow level at the top of stand pipe 14A, and in conjunction with the overhead plenum region formed by the cap portion 16, the residual body of urine 18 serves to trap sewer gasses from the external drain line in accordance with plumbing codes.

A body of oily liquid sealant 20, lighter than water or urine, floating in the entry compartment on top of the trapped body of urine 18, serves to trap odors from the urine 18 from escaping from trap 10A.

In operation of the urinal, urine from above, near the outer edge separates into droplets that permeate through the layer of sealant 20 and then join the main body of urine 18. As additional urine enters the body of urine 18, it overflows the stand pipe 14A and the overflow portion gravitates down the drain.

Known oil-sealed odor traps are configured as in FIG. 1 with a vertical baffle 16A. From actual experience, traces of sealant can escape during usage. Such depletion occurs as follows: in a form of turbulence or emulsification during each usage event, despite the inherent buoyancy of the sealant 20 due to its low density and the non-affinity to water/urine, some droplets of sealant, can separate from the main body and get swept downward along with the main flow of urine in the outer chamber. These stray droplets will tend to decelerate due their inherent buoyancy and, depending on downward urine flow velocity and travel depth, some of them may come to rest and then reverse and rise against the flow to return to the main sealant body above, and are thus recovered. However, any droplets that get dragged by the urine flow past the bottom of the baffle 16A, will then accelerate upwardly in the inner compartment 18 due to their buoyancy and will then escape down the drain conduit in stand tube 14A.

The present invention, operating on a modified form of the basic principle described above and teaching novel internal structure, can be implemented with the same general cylindrical exterior shape as that of the odor trap shown in FIG. 1, and can be made to fit into a cavity receptacle that is part of a urinal system having an entry bowl portion 12A above, leading to tapered upper edges of the outer wall of the main liquid container of odor trap 10A and extending downward around the trap 10A to a reduction portion 12B which connects by regular plumbing attachments to the external drain system.

Figure 1A:
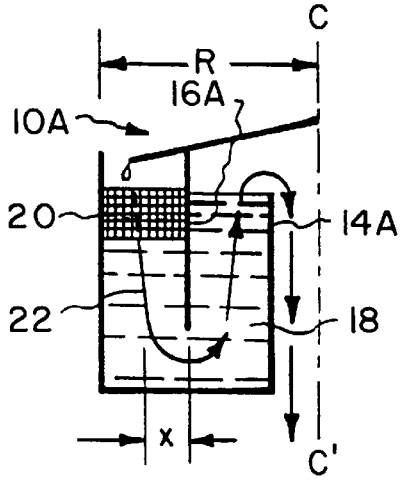
FIG. 1A is functional diagram representing the left hand half of FIG. 1.

FIG. 1A is a simplified schematic representation of the left hand half of the symmetrical configuration of FIG. 1 which is coaxial about a central axis C–C', showing again the relation of sealant 20, urine 18 and a sealant flow path 22 in the urine in the entry compartment. It is evident that in this configuration due to the vertical orientation of baffle 16A, the flow path 22 is predominantly vertical: downward in the outer compartment as shown and upward in the inner chamber, with only relatively small horizontal components around the bottom of baffle 16A and around the top of stand tube 14A. Flow path 22, having sealant 20 overhead, is the only portion of the total flow path where sealant recovery can occur, thus a corresponding parameter can be estimated as indicated by dimension X, representing the effective sealant-recovery horizontal flow path length. In a typical odor trap of the category of FIGS. 1 and 1A, with the main liquid container 14 having an inside radius R as indicated=

5.4 cm and the baffle 16A having an outside radius of 4 cm, the horizontal recovery dimension X is about 0.8 cm, from which we can express the unitless ratio X/R=14.8% characterizing this particular internal structure.

The component X labelled in the FIGS. 1s an approximate average of the horizontal vector components X of the wastewater flow, extending from the middle of the entry opening (e.g. the point of average entry of the wastewater into the sealant) to a furthest point along the flow path (e.g. around the baffle) in which sealant recovery can occur. Although the invention contemplates a value X based on the approximate average, preferably, generally all of the wastewater will follow a flow path having a component X, e.g. any wastewater not following such a flow path would be insubstantial enough to effect the proper functioning of the invention—such as if extraneous openings were provided allowing a minimal volume flow rate therethrough.

A vertical vector component Y of the flow path can be approximately defined as the vertical distance from the top of stand pipe 14A to the bottom of baffle 16A. Accordingly, an alternative feature can be based on a ratio X/Y, which can be used to estimate an effective slope of the flow path—for example, X/Y<1 indicating a predominantly vertical flow path and X/Y>1 indicating a predominantly horizontal flow path.

This category of odor trap is vulnerable to total loss of sealant if subjected to water-flushing at high pressure, due to the relatively narrow width of the outer compartment and absence of any sizeable shelter compartment around the entry region to which sealant can be displaced temporarily by the flushing water instead of being forced down the drain.

FIGS. 2–8 are simplified cross-sectional functional diagrams representing various odor trap configurations illustrating principles of the present invention, which is directed to preservation of sealant. For simplicity, as in FIG. 1A, only half of symmetrical cross-sections are shown, along with a central axis. The shapes shown generally apply to structure that is coaxial about the axis shown, but the invention could be practiced by applying such cross-sections to other, non-coaxial and/or non-symmetrical configurations such as rectangular containers or cylindrical containers with non-coaxial internal structure.

Figure 2:
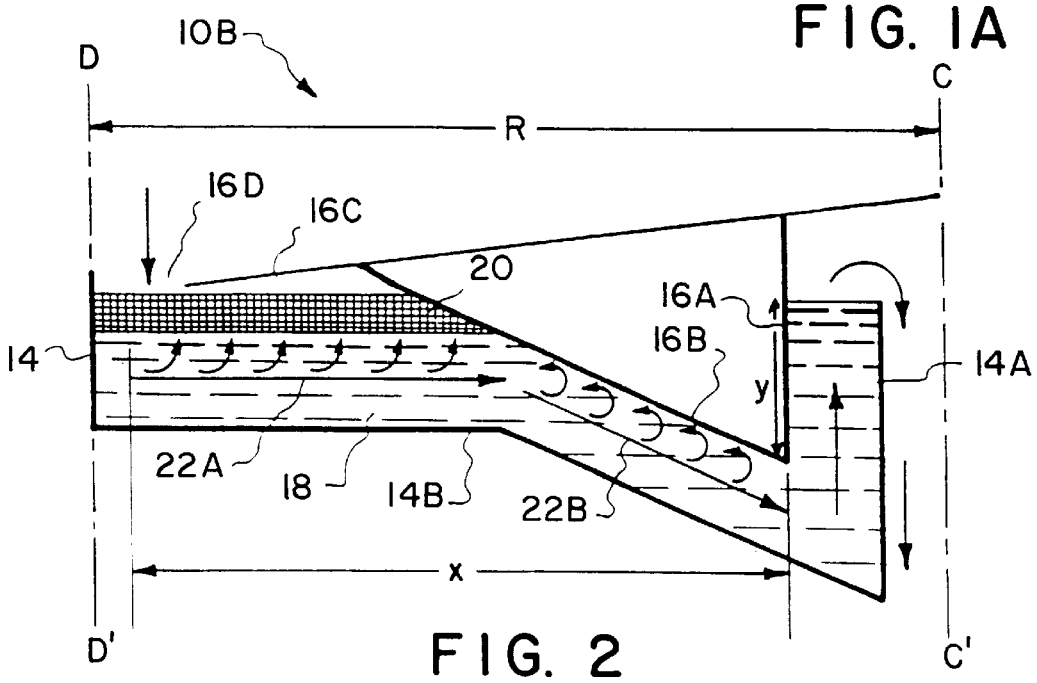
FIG. 2 is a functional diagram illustrating the principles of the present invention utilizing predominantly horizontal flow.

FIG. 2 is a conceptual diagram illustrating basic principles of the present invention wherein an odor trap 10B is structured in a novel manner: rather than making the baffle vertical as in FIGS. 1 and 1A, at least a portion of the baffle is shaped in a non-vertical manner to cause the liquid flow path to be predominantly horizontal, as a major departure from entirely vertical baffles and consequent predominantly vertical liquid flow that has been universal in known art as described above.

The baffle in FIG. 2 has a vertical portion 16A, facing the vertical wall of drain riser 14A, and an inclined-but substantially horizontal portion 16B sloping up to the cover 16C which has an entry opening 16D at the left. The contour of the bottom portion 14B of the main liquid container 14 is shown for simplicity as forming a flow path of substantially constant depth, however in practice there can be a much greater variation in depth along the flow path.

From the entry opening 16D at the left, the flow is to the right. The liquid flow path has two recovery portions 22A and 22B as indicated. In the portion 22A, starting at the entry inlet, the flow is horizontal, passing under the main body of sealant 20. Then in portion 22B the flow path slopes downward but remains predominantly horizontal as directed by the sloping baffle portion 16B. The flow path turns abruptly upward at the plane of vertical baffle portion 16A, to overflow riser 14A and then exits down the drain in the same manner as in FIGS. 1 and 1A.

It is evident that in both flow path portions 22A and 22B the flow path is predominantly horizontal, in distinction from the predominantly vertical flow paths in FIGS. 1 and 1A.

In FIG. 2 within the path length X indicated, practically all stray sealant droplets migrating upwardly to the top side of the flow path will be recovered and returned to the main body of sealant 20. In flow path portion 22A the body of sealant 20 is directly overhead, and along portion 22B the slope of baffle 16B redirects upwardly-migrating stray sealant back to the main body of sealant 20, as indicated by the curved arrows. Since sealant recovery occurs along both of these portions, the recovery dimension X as shown is the sum of the horizontal components of the two portions.

The cross-section of FIG. 2 can be applied to a coaxial cylindrical structure having a central axis about the line C–C' and the outer wall of cylindrical container being at D–D', such as the wall 14 as shown. Alternatively, the cross-section of FIG. 2 can be applied in reverse manner to provide a coaxial cylindrical odor trap structure of the central-entry type with a central axis at D–D' and the outer wall of the cylindrical container at C–C'.

As a further alternative, the cross-section of FIG. 2 can represent that of an enclosure that is other than cylindrical, e.g. rectangular. In addition, the container can alternatively be made with side walls at both D–D' and C–C' such that a non-symmetrical, non-axial, device is formed.

A coaxial structure based directly on FIG. 2 would tend to be shallower and larger in diameter than cartridges shaped as shown in FIG. 1. As a practical limitation, a minimum liquid depth is required in the trap to meet regulations regarding containment of sewer gas pressure in the drain system: e.g., 2 inches in the United States and 50 mm in Europe. Due to existing urinal space limitations, cylindrical traps are typically limited to a maximum diameter of about 150 mm (5.9") and a maximum height of about 90 mm (3.54"). To function properly in such a compact size, the conceptual example shown in FIG. 2 is preferably reconfigured in shape with the wasted space between the baffle portions 16A, 16B and the cover 16C more preferably being utilized.

The principles and advantages in sealant retention illustrated in FIG. 2 can be realized in various odor trap configurations according to the present invention, constructed and arranged to meet particular practical requirements, such as shown in the following examples.

FIG, 3 depicts the structure of an edge-entry odor trap 10C having the baffle configured with a vertical upper portion 16A and a sloped portion 16B as shown, providing a flow path 22 corresponding to horizontal recovery dimension X as shown, extending from an averaged entry point to the extremity of sloped baffle portion 16B.

Figure 3:
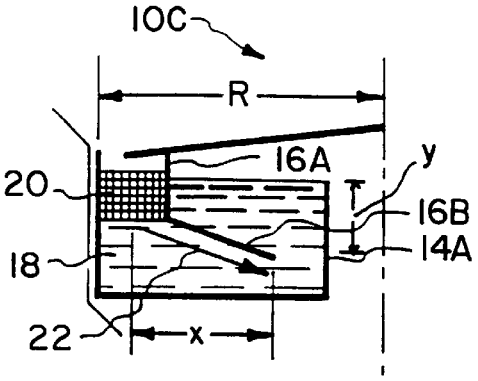
FIGS. 3 and 4 are functional diagrams illustrating two different baffle configurations in edge-entry coaxial trap structures according to the present invention.

In FIGS. 2 and 3, as viable baffle shape variations, the vertical portion 16A could be located anywhere along the sloped portion 16B between the extremes shown in these two FIGS. , while keeping the sloped portion 16B as shown: basic functioning and dimension X would be virtually unaffected.

Figure 4:
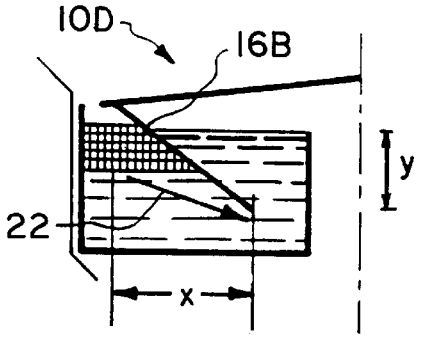

FIG. 4 depicts an odor trap 10D as a variation of FIG. 3 having baffle 16B sloped in its entirety. The flow path 22 and the dimension X are approximately the same as in FIG. 3.

Figure 5:
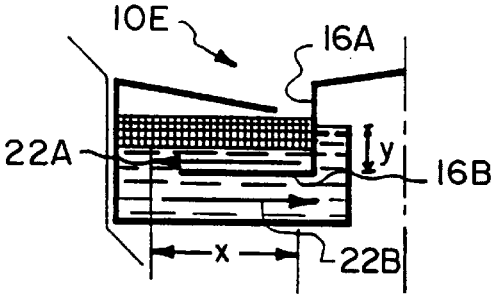
FIGS. 5–8 are functional diagrams illustrating different baffle configurations in center-entry coaxial odor trap structures according to the present invention.

FIG. 5 depicts a center-entry odor trap 10E wherein the baffle is configured with a vertical upper portion 16A and a horizontal lower portion 16B flanged outwardly as shown. This creates a folded liquid path having upper portion 22A above and lower portion 22B as shown. Only the upper portion 22A will be effective in returning stray sealant because the baffle 16B is not sloped. Thus, stray sealant in the portion 22B will tend to get swept along to the right and escape to the drain along with the effluent. The horizontal recovery dimension X will be as indicated, derived from the upper flow path portion 22A.

Figure 6:
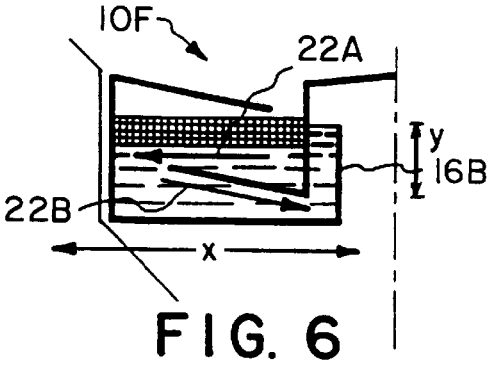

FIG. 6 depicts an odor trap 10F as a variation of FIG. 5 wherein the lower baffle portion 16B is sloped as shown so as to recapture stray sealant from the lower horizontal flow path 22B, thus adding to the upper path 22A to yield the much greater horizontal recovery dimension X indicated.

Figure 7:
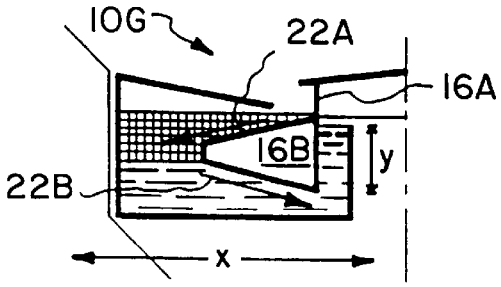

FIG. 7 depicts an odor trap 10G as a variation of FIG. 6 wherein the sloped flange portion 16B is made to have an oppositely-slope upper surface which serves to prevent accumulation of debris on the flange's upper surface which could otherwise occur in this region in the structure of FIG. 6. Dimension X is virtually the same as in FIG. 6.

Figure 8:
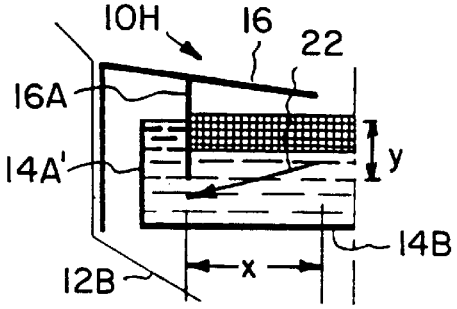

FIG. 8 depicts an odor trap 10H as a reversed version of the foregoing center entry coaxial configurations which achieves a form of predominantly horizontal flow path with a simple vertical baffle 16A surrounded by a drain stand wall 14A' which sets the overflow level. Wall 14A', surrounded by an outer wall extending down from the circumference of the cover 16C, is attached to the circumference of the floor 14B so as to form a simple cylindrical main container pan 14 which can be supported by the surrounding cover 16C or drain housing 12B by radial vanes (not shown). The center entry causes the liquid to spread out radially in a sloped but substantially horizontal flow path 22 leading to the bottom edge of the baffle 16A as shown, corresponding to recovery dimension X as indicated.

In FIGS. 5–8, a triangular-shaped empty region can be seen in cross-section above the sealant, as formed by the slope of the cover. This triangular region serves an important function as a sealant shelter region into which the sealant tends to be displaced in the event of high-pressure water flushing, instead of being forced down the drain ahead of the flushing water, as could occur with trap structure of known art, such as in FIGS. 1 and 1A, having the conventional vertical baffle 16A and the conventional predominantly vertical flow paths.

Figure 9:
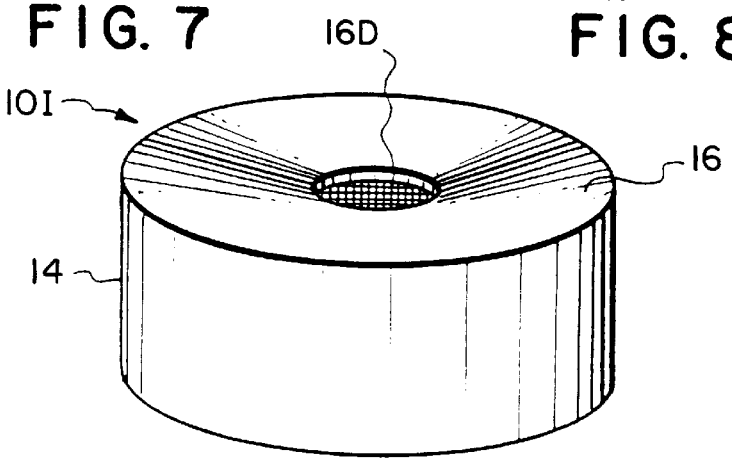
FIG. 9 is a three-dimensional view of a center-entry cylindrical odor trap cartridge.

FIG. 9 is a three-dimensional view of a cylindrical odor trap cartridge 101 with center entry 16D in accordance with a preferred embodiment of the present invention. The upper surface slopes downward in a shallow inverted cone toward the center where the entry opening 16D is fitted with a filter screen or a fine perforation pattern formed in the cover material.

The enclosure can be, for example, dimensioned about 4½"(11.4 cm) in diameter and 2¾"(7.0 cm) in height. As noted, due to existing industry limitations, the size of the trap is to be limited. For example, the radius of the trap is preferably between about 2–2½"(5–6.4 cm). It is preferably molded from polyethylene, or from another suitable plastic material such as polypropylene, ABS or polystyrene, to provide a smooth stain-resistant surface. The material can also include a fiberglass reinforced polyester. Other suitable materials can also be utilized. Typically, the main container 14 and cap/partition part 16 are molded as separate parts and then bonded together to form an integral enclosure, since access to the interior is not normally required. The entry configuration of trap 10I makes it feasible to seal the entry opening 16D (with the bottom exit opening, not visible in FIG. 9, sealed in a similar or other manner) for shipment as a cartridge already charged with sealant, ready for deployment. For example, to seal the opening 16D, a sticker can be attached thereto, such sticker can further include labelling, etc., such as installation instructions and product labelling.

Figure 10:
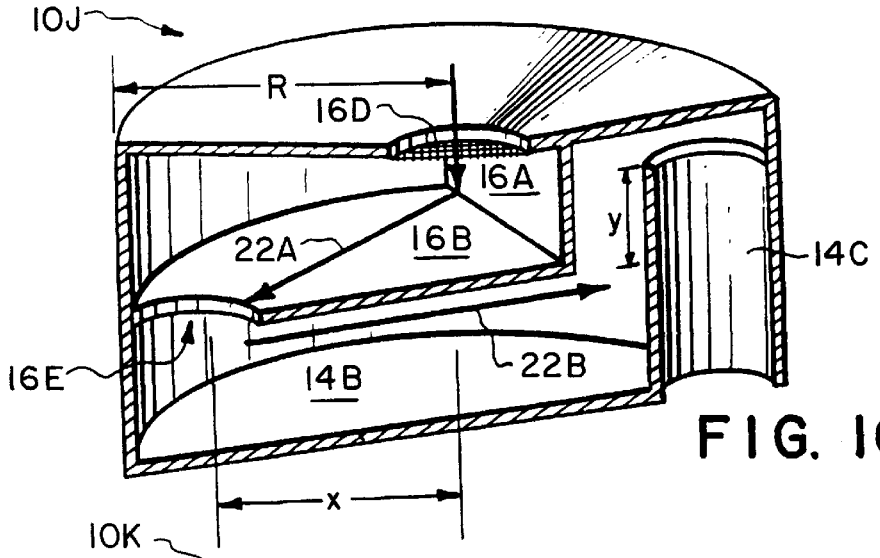
FIG. 10 is a three-dimensional cutaway view of an embodiment of a horizontal-flow odor trap cartridge of the present invention having a cylindrical container and a non-coaxial internal configuration with vertical and horizontal baffle portions and an offset tubular drain stand.

FIG. 10 is a three-dimensional cutaway view of a center-entry cylindrical odor trap 10J having a non-coaxial interior configuration, shown without liquid for clarity. The baffle has two flat portions: vertical portion 16A extending downward from the upper surface offset to the right of entry opening 16D. At the bottom of vertical baffle portion 16A, a horizontal portion 16B extends fully to the left hand wall of odor trap 10J. A round opening 16E, about the same size as opening 16D, is configured in a horizontal baffle portion 16B at the edge furthest from vertical baffle portion 16A. Opening 16E leads into a lower compartment which is configured with a flat floor 14B of which a portion is extended upwardly at the right hand side to form tubular drain stand 14C whose top edge defines the overflow level of the container as in the FIGS. described above. The two liquid flow paths 22A and 22B are shown and the corresponding recovery path dimension X is indicated as derived from path 22A.

Figure 11:
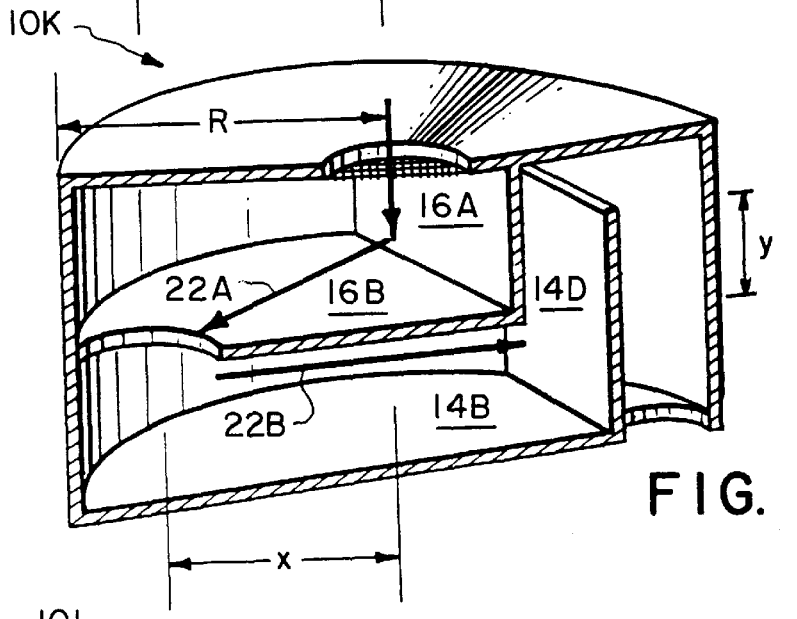
FIG. 11 shows an alternative illustrative embodiment derived from FIG. 10 with a flat-partitioned drain stand.

FIG. 11 depicts an odor trap 10K which is a variation having a baffle configured as in FIG. 10 but wherein the drain riser 14D is here configured as a flat vertical riser wall 14D attached integrally to floor 14B and to the interior wall of the main enclosure 14 of odor trap 10L, preferably molded together in one piece.

Figure 12:
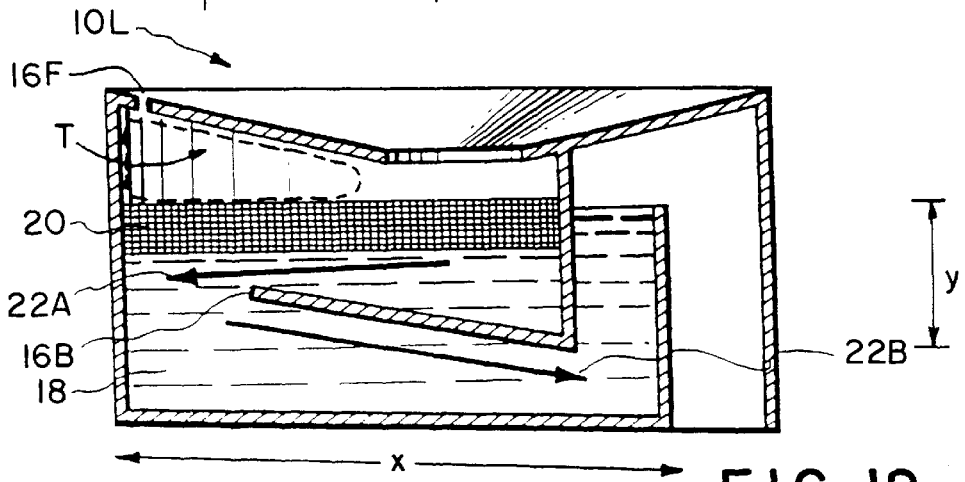
FIG. 12 shows a cross-sectional view of a preferred embodiment of the present invention, similar to FIGS. 10 or 11, but having the lower baffle portion sloped for additional recovery of stray sealant.
Figure 15:
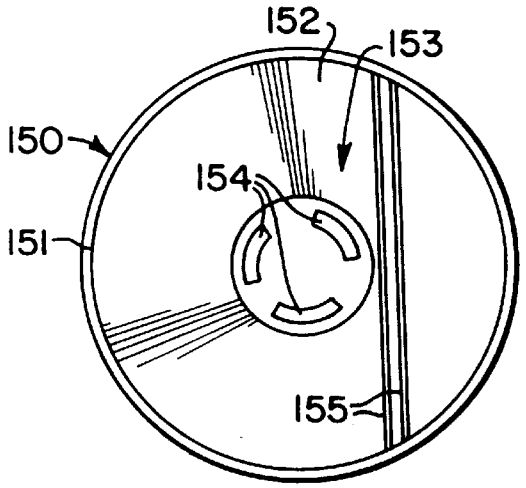
FIGS. 15–18 show one preferred construction of the preferred embodiment of FIG. 13.
Figure 16:
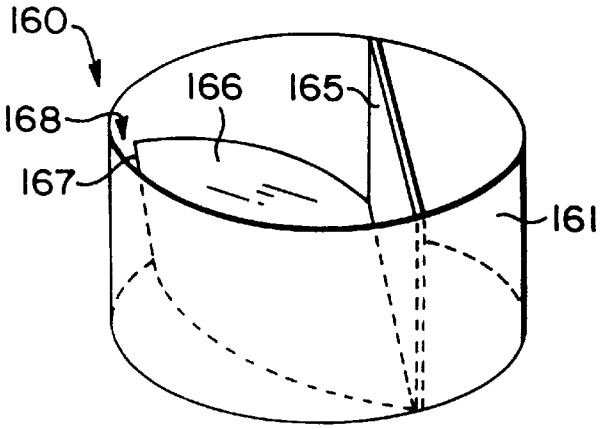

FIG. 12 is a central cross-section depicting an odor trap that represents an important variation applicable to both FIG. 10 and FIG. 11. The horizontal baffle portion 16B is sloped in a manner to recover stray sealant and return it to the main body of sealant 10. The resultant horizontal recovery dimension X is much longer than in FIGS. 10 and 11 due to the additional recovery provided by the sloped baffle portion 16B.

It is seen that the cross-sections of FIGS. 10 and 11 generally resemble that of FIG. 5, and the cross-section of FIG. 12, generally resembles that of FIG. 6. However, preferred constructions according to FIGS. 5 and 6 as shown imply fully coaxial internal and external configuration centered on axis C–C' whereas the internal structure in FIGS. 10–12 is clearly non-coaxial with the outlet offset rather than centered and the baffles flat rather than cylindrical.

The relative sealant recovery effectiveness of the above configurations as approximated by the recovery-effective length of the horizontal flow paths X relative to container radius R can be compared in the following estimated table. The following Table 1 lists examples of estimated values which can be achieved for X/R in the illustrated embodiments, the illustrated embodiments not being limited thereto:

TABLE 1

| FIG. | X/R |
|---|---|
| 1, 1A | 15% |
| 2 | 76% |
| 3, 4, 5 | 50% |
| 6, 7 | 105% |
| 8 | 56% |
| 10, 11 | 71% |
| 12 | 165% |

Alternatively, the relative sealant recovery effectiveness of the above configurations, as a few examples, can be expressed as a function of the flow path slope X/Y. The following Table 2 lists estimated examples of values which can be achieved for X/Y in the illustrated embodiments, the illustrated embodiments not being limited thereto.

TABLE 2

| FIG. | X/Y |
|---|---|
| 1, 1A | 0.12 |
| 2 | 4.64 |
| 3, 4 | 3.50 |
| 5 | 5.50 |
| 6 | 5.75 |
| 7 | 8.60 |
| 8 | 3.67 |
| 10, 11 | 3.08 |
| 12 | 5.82 |

According to the preferred embodiments of the present invention, the inlet and outlet locations and the baffle configuration, etc., result in a predominantly horizontal flow. For example, in some preferred embodiments, the present invention yields preferred-values of X/R>30%, as distinguished, for example, from predominantly vertical flow of known art in the above table. As seen in Table 1, the present invention can even yield values greater than 50%, allowing for a wide margin above the 15% estimated for the noted prior art. As another example, the present invention can yield preferred values of X/Y of greater than 1.0, while the above-noted estimate of the noted prior art achieves a value substantially less than 1.0. Although clearly less preferred, it is contemplated that values less than the preferred examples of X/R and/or X/Y can, in some cases, be used according to principles of the invention.

It is recognized that as a one-dimensional parameter such as X/R is merely a first approximation of effectiveness: a more refined two-dimensional parameter could take into account the effective horizontal recovery area located above the flow path. An even more refined three-dimensional parameter could take into account fluid viscosities, width, depth and length and resulting flow velocities at various incremental points in the flow paths.

The relative effectiveness indicated by the above tables apply to normal operation and does not necessarily include the additional improvement provided by the present invention in protection against catastrophic loss of sealant under the condition of high pressure water flushing as described above. In this regard, according to another aspect of the invention, a shelter region is provided for the sealant, such a shelter region can be provided in any of the embodiments of the invention. The configurations of the embodiments of, for example, FIGS. 10–12 include entry compartments with shelter regions (e.g., T shown in FIG. 12) wherein high-pressure flushing water tends to take a direct path from entry opening 16D to baffle opening 16E while parting much of the sealant and temporarily pushing it into the shelter regions at both sides. Among other things, the angled top wall and the wide entry compartment helps provide such shelter regions. The shelter region is preferably formed by an airspace above the normal sealant level, such as shown within T in FIG. 12. In order to allow the sealant to quickly enter the shelter region, the device can include one or more air vents to allow air within the shelter region to vent outside thereof. For example, the embodiment shown in FIG. 12 includes at least one air vent 16F at an upper end of the trap. The air vent 16F is preferably sized to allow air to pass therethrough while substantially preventing fluid flow therethrough, and preferably has a diameter of about 1–2 mm. As shown, the air vent is preferably in the top wall of the device. In this manner, in the event the any sealant is forced through the air vent, the sealant can be redirected along the upper surface and into the upper opening 16D so as to return to the body of sealant.

FIG. 13 shows another preferred embodiment of the invention. The device shown in FIG. 13 employs a number of features which are similar to certain features shown in FIGS. 10–12. FIG. 13 is a three-dimensional cutaway view of an odor trap 10M having a non-coaxial interior configuration. The baffle has a generally vertical portion 16A extending downward from the upper surface, offset to the right of entry opening 16D, and a horizontal portion 16B extending fully to the left hand wall of odor trap 10M at the bottom of vertical baffle portion 16A. The horizontal baffle extends only partially across the trap so as to leave an opening 16E at the edge furthest from vertical baffle portion 16A. The opening 16E leads into a lower compartment which is configured with a floor 14B. A tubular drain stand 14C is provided which extends upward at the right hand side of the floor 14B. The top edge of the drain stand 14C defines the overflow level of the container. The two liquid flow paths 22A and 22B shown provide a corresponding recovery path dimension X similar to that shown in FIG. 12—e.g., the sum X1+X2 from the paths 22A and 22B, respectively. As shown in FIG. 13, a body of wastewater 18 has a sealant layer 18 buoyantly floating thereon. The wastewater 18 follows the flow path a) 221 into the entry opening 16D, b) 22A above the baffle, c) 22B below the baffle 16B, d) 22C up and over the top edge of the drainstand 14C, and e) 22D down the drainstand 14C.

Figure 18:
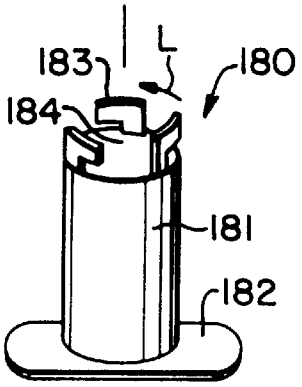
Figure 17:
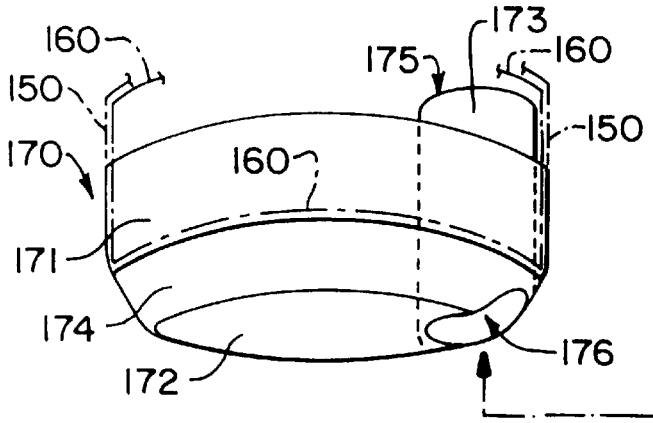

FIGS. 15–18 show one preferred construction of the embodiment shown in FIG. 13. This preferred construction includes a top member 150 (FIG. 15), a middle member 160 (FIG. 16), a bottom member 170 (FIG. 17), and a plug member 180 (FIG. 18). The top member 150 includes a generally cylindrical perimeter wall 151, a downwardly inclined top wall 152, and an entry opening 153 at the center of the top wall. The top wall 152 is inclined in a manner like that in FIG. 13. As shown, the entry opening preferably includes three holes 154 in the center area of the top wall. The top wall also preferably includes two sealing ridges 155 for receiving and sealing the baffle 165 (discussed below).

The middle member 160 includes a perimeter wall 161 and a baffle having a generally vertical portion 165 and an upwardly inclined portion 166. The portion 166 has a generally straight upper edge 167 providing a fluid passage 168 around the baffle.

The bottom member 170 includes a perimeter wall 171, a bottom wall 172, and a upwardly extending drain stand 173. The drain stand preferably is a cylindrical tube extending above the wall 171 with an upper opening 175 and a lower opening 176. The lower edge of the bottom member can, for example, as shown include a tapered wall 174.

The device is assembled with the middle member fitted such that the perimeter wall 161 snugly fits within the perimeter wall 151 and the baffle portion 165 snugly fits between the ridges 155. The wall 151 only extends down over part of the height of the wall 161. The lower member 170 fits with the drain stand 173 within the area to the right of the baffle portion 165 and the lower portion of the cylindrical wall 161 snugly fitted within the cylindrical wall 171. As a result, a sealed container can be constructed having separately isolated entry and discharge compartments.

FIG. 18 shows a plug-handle member 180 which can be included in this latter embodiment. The plug-handle member 180 preferably includes a tubular member 181, handle projections 182. and L-shaped projections 183 at the upper wall 184. The plug is preferably shaped and sized so as to snugly fit within the drain stand 173. With this construction, the odor trap can be transported with a body of sealant within the assembled structure, if a plug 180 is inserted in the opening 176 and a seal (such as an adhesive backed label) is placed over the opening 153. As shown, the L-shaped projections are sized and shaped to fit within the holes 154 so that the assembled device can be carried by simply inserting the projections into the holes 154 and rotating the plug 180 in the direction L, FIG. 18, so that the L-shaped projections engage under the top wall 152. Thus, the member 180 provide a tool that can be used to seal a new, unused, unit and to remove a dirty, wastewater filled, unit. Although the plug and handle functions are preferably combined into the single tool 180, it is contemplated that separate devices embodying these features can be included and/or either the plug or handle can be eliminated depending on the desired handling.

The sealant 20 is preferably a biodegradable oily liquid. A preferred composition of liquid 20 comprises an aliphatic alcohol containing 9–11 carbons in the chemical chain, wherein the specific gravity is 0.84 at 68 degrees Fahrenheit. Since the operation of the urinal is based on the differential between the specific gravity of the oily liquid and that of urine, typically near 1.0, the specific gravity of the oily liquid should be made as low as possible, preferably not exceeding 0.9 and, more preferably, well under 0.9. The-sealant preferably 20 is chosen to have a very low affinity to water such that sealant and the urine strongly repel each other physically so that there is no chemical or other interaction apart from a purely physical separation which allows urine/water from above to divide finely and permeate downwardly through the sealant layer. The sealant 20 is preferably colored, e.g. blue, for maintenance and identification purposes.

FIG. 14 shows one example of type of urinal into which the various odor traps, shown generally as 10, can be located. The illustrated urinal 140 being a wall mounted unit attached above a floor surface (not shown). The urinal shown is for illustrative purposes only; a trap of the present invention can be used in any type of urinal. More notably, the utility of the invention, while directed in some aspects to waterless urinals as illustrated above, is not restricted thereto. The present odor trap is applicable to other drained surfaces and the like. For example, since the preferred sealant utilized is considerably more stable than water with regard to evaporation, the present invention has widespread utility as floor drains, solving, for example, problems of sewer gas release from conventional S type floor drains resulting from, for example, total seal failure due to evaporation of the residual water and lack of replenishment thereof, particularly in hot, dry climates.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description. Furthermore, all variations, substitutions and changes which come within the meaning and range of equivalency of the claims are therefore intended to be embraced therein.

What is claimed is:

1. An odor trap apparatus, comprising:

a main liquid container having a top cover;

at least one opening in said top cover through which substantially all of the wastewater enters into said container;

a baffle in said container dividing said container into 1) an entry compartment receiving wastewater through said at least one opening in said top cover and 2) a discharge compartment receiving wastewater from said entry compartment along a liquid flow path beneath said baffle;

a drain stand in the discharge compartment having an upper edge defining an overflow level of said container and having a bottom outlet communicating with an external drain;

said container being adapted to contain a quantity of low-density liquid to form a sealant layer when said container has a body of wastewater filled to the overflow level with the layer of liquid sealant floating on the body of wastewater in the entry compartment;

characterized in that the improvement comprises:

a horizontal distance (X) measured from each said at least one opening in said top cover to an end of said baffle around which the wastewater passes is larger than a vertical distance (Y) measured from said overflow level to the bottom of said baffle such that said liquid flow path beneath said baffle is predominantly horizontal.

2. The apparatus as defined in claim 1, wherein said baffle includes a vertical portion at an upper region in said container and non-vertical portion extending toward the entry compartment from a lower end of said vertical portion of said baffle.

3. The apparatus as defined in claim 2, wherein said non-vertical portion of said baffle is sloped upwards from said lower end to cause stray low-density liquid droplets to be directed upwardly along said baffle.

4. The apparatus as defined in claim 1, wherein a substantial portion of said flow path is located immediately beneath the body of low-density liquid.

5. The apparatus as defined in claim 1, wherein said baffle includes a sloped portion located immediately above a substantial portion of said flow path and guiding upwardly-migrating stray droplets of low-density liquid to return to a body of low-density liquid.

6. The apparatus as defined in claim 1, wherein said container is generally cylindrical, and wherein said horizontal distance (X) is at least 30% of the radius of said cylinder.

7. The apparatus as defined in claim 6, wherein said radius is about 2 to 2½ inches (5–6.4 cm).

8. The apparatus as defined in claim 1, wherein said container has a dimension (R), at a height at the bottom of said baffle, from a center of the container to a side thereof, and wherein said horizontal distance (X) is at least 30% of said dimension (R).

9. The apparatus as defined in claim 1, wherein said container has a generally constant radius over the entire height of a vertical portion of said baffle extending generally downwardly into said container.

10. The apparatus as defined in claim 1, wherein said container includes a shelter region in an upper portion thereof adjacent said at least one entry opening, said shelter region accepting low-density liquid temporarily displaced by water flushed into said apparatus following said flow path to shelter and prevent loss of the displaced low-density liquid.

11. The apparatus as defined in claim 11, further including an air vent at an upper end of said container connected to said shelter region.

12. The apparatus as defined in claim 11, wherein said top cover is sloped downward with said at least one opening at a lower side of said slope and said shelter region under an upper side of said slope.

13. The apparatus as defined in claim 1, further including a tool member fittable within said drain stand and having projections that are engageable with said at least one opening for carrying said container.

14. The apparatus as defined in claim 1, further including a quantity of low-density liquid in said container and a plug member sealingly fitted within said drain stand and an adhesive label placed over said at least one opening such that said low-density liquid is contained within said container.

15. The apparatus as defined in claim 1, wherein said container is made from a plastic material.

16. The apparatus as defined in claim 15, wherein said container is made from a plastic material selected from a group including polyethylene, polypropylene and fiberglass-reinforced polyester.

17. The apparatus as defined in claim 1, further including a low-density liquid in said container that is an oily liquid.

18. The apparatus as defined in claim 1, further including a low-density liquid in said container that is an aliphatic alcohol.

19. The apparatus as defined in claim 18, wherein said aliphatic alcohol contains a chemical chain of carbons ranging in number from nine to eleven.

20. The apparatus as defined in claim 1, further including a low-density liquid in said container that has a specific gravity not exceeding 0.9.

21. The apparatus as defined in claim 1 in combination with a draining surface member for directing wastewater into said at least one entry opening.

22. The apparatus as defined in claim 21, wherein said draining surface member is a wall mounted urinal.

23. The apparatus as defined in claim 21, wherein said draining surface member is a floor surface.

24. An odor trap apparatus, comprising:

a main liquid container having a top cover;

at least one opening in said top cover through which substantially all of the wastewater enters into said container;

a baffle in said container dividing said container into 1) an entry compartment receiving wastewater through said at least one opening in said top cover and 2) a discharge compartment receiving wastewater from said entry compartment along a liquid flow path beneath said baffle;

a drain stand in the discharge compartment having an upper edge defining an overflow level of said container and having a bottom outlet communicating with an external drain;

said container being adapted to contain a quantity of low-density liquid to form a sealant layer when said container has a body of wastewater filled to the overflow level with the layer of liquid sealant floating on the body of wastewater in the entry compartment;

characterized in that the improvement comprises:

a horizontal distance (X) measured from each said at least one opening in said top cover to an end of said baffle around which the wastewater passes is greater than 30% of a dimension (R), at a height at the bottom of said baffle, from a center of the container to a side thereof.

25. The apparatus as defined in claim 24, wherein said horizontal distance (X) is greater than 50% of said dimension (R).

26. The apparatus as defined in claim 24, wherein said baffle includes a vertical portion at an upper region in said container and non-vertical portion extending toward the entry compartment from a lower end of said vertical portion of said baffle.

27. The apparatus as defined in claim 24, wherein said non-vertical portion of said baffle is sloped upwards from said lower end to cause stray low-density liquid droplets to be directed upwardly along said baffle.

28. The apparatus as defined in claim 24, wherein a substantial portion of said flow path is located immediately beneath the body of low-density liquid.

29. The apparatus as defined in claim 24, wherein said baffle includes a sloped portion located immediately above a substantial portion of said flow path and guiding upwardly-migrating stray droplets of low-density liquid to return to a body of low-density liquid.

30. The apparatus as defined in claim 24, wherein said container is generally cylindrical, and wherein said horizontal distance (X) is at least 30% of the radius of said cylinder.

31. The apparatus as defined in claim 24, wherein said radius is about 2 to 2½ inches (5–6.4 cm).

32. The apparatus as defined in any of claims 24, wherein said container has a generally constant radius over the entire height of a vertical portion of said baffle extending generally downwardly into said container.

33. The apparatus as defined in claim 24, wherein said container includes a shelter region in an upper portion thereof adjacent said at least one entry opening, said shelter region accepting low-density liquid temporarily displaced by water flushed into said apparatus following said flow path to shelter and prevent loss of the displaced low-density liquid.

34. The apparatus as defined in claim 33, further including an air vent at an upper end of said container connected to said shelter region.

35. The apparatus as defined in claim 34, wherein said top cover is sloped downward with said at least one opening at a lower side of said slope and said shelter region under an upper side of said slope.

* * * * *